US005221172A

United States Patent [19]

Theurer et al.

[11] Patent Number: 5,221,172

[45] Date of Patent: Jun. 22, 1993

[54] FREIGHT CAR FOR BULK MATERIAL

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 792,895

[22] Filed: Nov. 15, 1991

[30] Foreign Application Priority Data

Dec. 14, 1990 [AT] Austria ..... 2540/90

[51] Int. Cl.[5] ..... B65G 67/08

[52] U.S. Cl. ..... 414/339; 414/343; 414/505; 414/523; 414/528

[58] Field of Search ..... 414/339, 523, 528, 343, 414/345, 503-505; 198/587, 589; 104/2

[56] References Cited

U.S. PATENT DOCUMENTS

| | | | |
|---|---|---|---|
| 1,462,078 | 7/1923 | Williams et al. | 198/587 |
| 2,724,515 | 11/1955 | Scheuchzer et al. | 414/339 |
| 3,842,994 | 10/1974 | Theurer et al. | 414/339 |
| 4,361,219 | 11/1982 | Aldridge et al. | 198/587 X |
| 4,387,798 | 6/1983 | Jamison et al. | 198/587 |
| 4,576,538 | 3/1986 | Theurer et al. | 414/339 |
| 4,742,938 | 5/1988 | Niewold | 414/523 X |
| 4,809,617 | 3/1989 | Theurer et al. | 414/339 X |
| 4,829,907 | 5/1989 | Theurer et al. | 414/339 X |
| 4,834,463 | 5/1989 | Dye | 414/523 X |

FOREIGN PATENT DOCUMENTS

| | | | |
|---|---|---|---|
| 964128 | 5/1957 | Fed. Rep. of Germany | 198/587 |
| 2146590 | 3/1972 | Fed. Rep. of Germany . | |
| 212544 | 8/1984 | German Democratic Rep. . | |

*Primary Examiner*—David A. Bucci
*Attorney, Agent, or Firm*—Collard & Roe

[57] ABSTRACT

A freight car comprises an elongated frame supported on undercarriages, an elongated box for holding bulk material, the box being mounted on the frame and having a bottom and an open top, an elongated conveyor at the bottom of the box for transporting the bulk material in a conveying direction, the conveyor having an input at one end of the box and an output at a box end opposite to the one end, and a transfer conveyor extending in the conveying direction and arranged to receive the transported bulk material from the output of the conveyor, the transfer conveyor having a free end projecting beyond the opposite box end. A centering device is arranged at the one box end transversely displaceably with respect to the elongated frame and transfer conveyor, the free end of a transfer conveyor of a like freight car coupled to the frame at the one box end being detachably connectable to the centering device, and a remote-controlled drive is provided for transversely displacing the centering device.

7 Claims, 1 Drawing Sheet

FREIGHT CAR FOR BULK MATERIAL

BACKGROUND OF THE INVENTION

1. Field of the Invention

The present invention relates to a freight car for bulk material, which comprises an elongated frame defining a plane and supported on undercarriages, an elongated box for holding the bulk material, the box being mounted on the frame and having a bottom and an open top, an elongated conveyor means at the bottom of the box for transporting the bulk material in a conveying direction longitudinally extending along the box, the conveyor means having an input at one end of the box and an output at a box end opposite to the one end, a transfer conveyor extending in the conveying direction and arranged to receive the transported bulk material from the output of the conveyor means, the transfer conveyor having a free end projecting beyond the opposite box end, and a centering device for the free end of a transfer conveyor of a like freight car coupled to the frame at the one box end, the free transfer conveyor end of the like freight car being detachably connectable to the centering device.

2. Description of the Prior Art

U.S. Pat. No. 4,576,538, dated Mar. 18, 1986, discloses such a freight car and how such cars may be coupled together in an advantageous manner to form a freight train. The free end of the transfer conveyor of each car projects above the open top of the box of the following car in the conveying direction to fill the box with the transported bulk material. Any number of such freight cars may be coupled together to form a train of any desired length, and such a train may be advantageously used to transport bulk material coming from a ballast cleaning machine, for example, from a rear car adjacent the machine to a front car where it is stored. The free transfer conveyor end is attached to a centering device on the adjacent car so that it is automatically laterally pivoted about a vertical axis in track curves. However, in highly superelevated track curves, this pivoting does not effectively center the free transfer conveyor end over the bottom conveyor means in the box into which it empties the bulk material.

U.S. Pat. No. 3,842,994, dated Oct. 22, 1974, German patent application No. 2,146,590, published Mar. 23, 1972, and German Democratic Republic patent No. 212,544, of Aug. 15, 1984, deal with freight cars equipped with overhead conveyors for transporting bulk material from car to car, the conveyors being displaceable relative to each other in a longitudinal direction to enable the conveyors to be adjusted with respect to each other.

SUMMARY OF THE INVENTION

It is the primary object of this invention to improve a freight car of the first-described type so that no problems will arise in superelevated track sections in the smooth transfer of the transported bulk material from one car to the next.

In a freight car for bulk material, which comprises an elongated frame defining a plane and supported on undercarriages, an elongated box for holding the bulk material, the box being mounted on the frame and having a bottom and an open top, an elongated conveyor means at the bottom of the box for transporting the bulk material in a conveying direction longitudinally extending along the box, the conveyor means having an input at one end of the box and an output at a box end opposite to the one end, and a transfer conveyor extending in the conveying direction and arranged to receive the transported bulk material from the output of the conveyor means, the transfer conveyor having a free end projecting beyond the opposite box end, the above and other objects are accomplished according to the invention by arranging the centering device transversely displaceably with respect to the elongated frame and transfer conveyor, the free end of a transfer conveyor of a like freight car coupled to the frame at the one box end being detachably connectable to the one box end, and providing a remote-controlled drive for transversely displacing the centering device. In this way, even if the bulk material is transferred between several cars in a superelevated track section, an otherwise increasing accumulation of the transported bulk material at one side of the boxes is dependably prevented.

According to one preferred feature of the present invention, the centering device is affixed to the box at the one end thereof and the free end of the transfer conveyor of the like freight car being detachably connectable to the centering device. A remote control for the drive may be arranged at the opposite box end. This enables an operator, who has an unhindered view of centering movement of the free transfer conveyor end, to actuate the transverse displacement drive as long as necessary to assure that the bulk material discharged from the transfer conveyor end is properly centered on the bottom conveyor means in the box.

According to a further feature of this invention, two support ledges are mounted on an underside of the transfer conveyor at the free end thereof, the support ledges being spaced from each other transversely with respect to the conveyor means and extending in the longitudinal direction of the transfer conveyor, and the support ledges being arranged to support the free transfer conveyor end on the centering device. This provides a secure support of the free transfer conveyor end on the centering device without hindering its longitudinal displacement with respect to the centering device mounted on the freight car box, which takes place when the free transfer conveyor end is pivoted for centering in track curves, while the transverse displacement forces are dependably transmitted from the drive to the support ledges.

If the free end of the transfer conveyor projects beyond an end of the frame carrying a buffer for coupling a like freight car thereto, and the projecting free end of the transfer conveyor has an underside detachably connectable to the centering device of a like freight car following the freight car in the conveying direction, the centering device will be well protected from damage and against adverse weather conditions, such as rain and snow, particularly when the car stands alone and is not coupled to other cars in a train, since the overlying conveyor will extend over it.

In a preferred embodiment, a cross level automatically controls the transverse displacement drive of the centering device. In this way, the proper centering need not be effected by an operator but is done automatically, which is not only more dependable but also saves labor. The cross level controls the transverse displacement stroke automatically in response to the extent of the track superelevation determined by the cross level.

According to another embodiment, the centering device comprises two flaps spaced from each other transversely with respect to the transfer conveyor by a distance approximating the width thereof, the transfer conveyor having two side walls adjacent the flaps and the flaps being pivotal about an axis extending in the longitudinal direction of the frame for selective engagement with the transfer conveyor side walls. This will secure the transfer conveyor against being moved out of position on the centering device when it is subjected to sudden accidental impacts, which prevents damages and also loss of bulk material.

The centering device is arranged for laterally pivoting the free transfer conveyor end, and means may be provided for stopping the pivotal flaps in a vertical position for limiting the lateral pivoting of the free transfer conveyor end and in a horizontal position for permitting the lateral pivoting. This arrangement enables the transfer conveyor to be used also for emptying the freight car by depositing the bulk material laterally adjacent the track, including a freight car on a neighboring track, without having to lift the transfer conveyor above the flaps. It also facilitates the attachment of the free transfer conveyor end to the centering device on an adjacent freight car.

BRIEF DESCRIPTION OF THE DRAWING

The above and other objects, advantages and features of the present invention will become more apparent from the following description of a now preferred embodiment thereof, taken in conjunction with the accompanying somewhat schematic drawing wherein.

DETAILED DESCRIPTION OF PREFERRED EMBODIMENT

Figure 1:
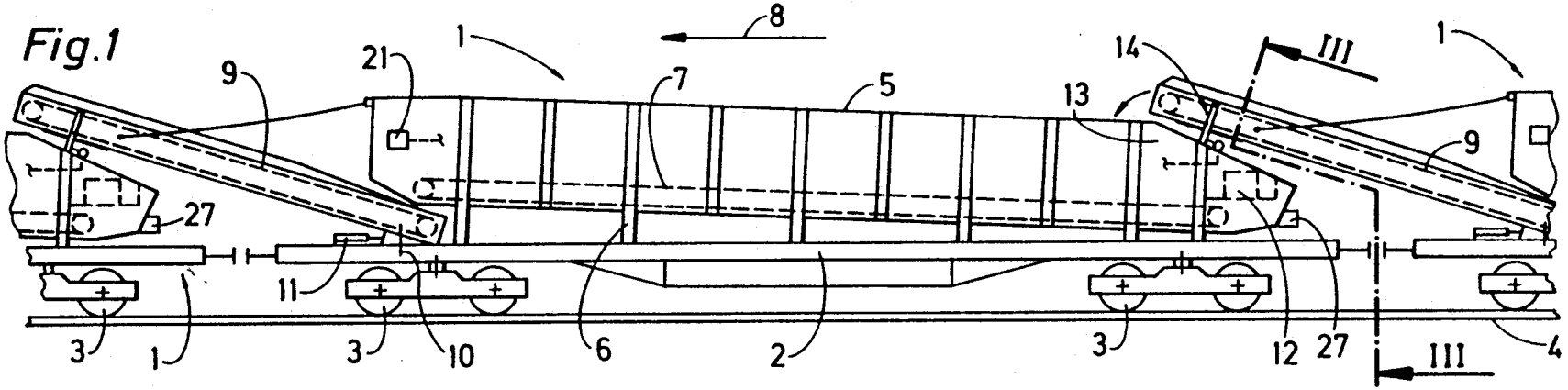
FIG. 1 is a side elevational view of a freight car having like freight cars coupled to both ends thereof.

Referring now to the drawing, FIG. 1 shows freight car 1 for bulk material, which comprises elongated frame 2 supported on undercarriages 3 running on track 4. Elongated box 5 for holding the bulk material is mounted on frame 2 and has an open bottom and an open top. Supports 6 of unequal lengths, i.e. lengths progressively increasing upstream in a conveying direction indicated by arrow 8, hold box 5 on the frame in an inclined position and elongated conveyor means 7 at the bottom of the box is driven to transport the bulk material in the conveying direction longitudinally extending along the box. Conveyor means 7 rises from an input at one end 13 of the box to an output at a box end opposite to the one end 13. Transfer conveyor 9 extends in the conveying direction and is arranged to receive the transported bulk material from the raised output of conveyor means 7, the transfer conveyor having an elevated free end projecting beyond the opposite box end. The transfer conveyor has its own drive. The lower end of transfer conveyor 9 is mounted on vertical pivot 10 affixed to frame 2 and pivoting drive 11 is connected to the transfer conveyor for pivoting it about pivot 10 so that the transfer conveyor may unload bulk material at either side of track 4. Freight car 1 carries a central source of energy 12 for powering all the drives. Like freight cars 1 are partially shown at each end of freight car 1, the freight cars being coupled together by conventional buffers at the facing ends.

In the illustrated embodiment, centering device 14 is arranged at the one box end 13 and is, according to this invention, transversely displaceable with respect to elongated frame 2 and transfer conveyor 9. The free end of a transfer conveyor 9 of a like freight car 1, which is coupled to the frame at the one box end, is detachably connectable to centering device 14, and remote-controlled drive 20 is arranged for transversely displacing the centering device. As shown in FIG. 1, a remote control 21 for drive 20 (FIG. 2) may be mounted at the opposite box end. However, and instead of the operator control, a cross level 27 may automatically control transverse displacement drive 20 of centering device 14. In this way, the bulk material may be transferred from one freight car to the adjacent downstream freight car and may be discharged from the free end of transfer conveyor 9 onto input 13 of bottom conveyor means 7.

As shown in the drawing, the free end of transfer conveyor 9 projects beyond an end of frame 2 carrying a buffer for coupling a like freight car 1 thereto, and the projecting free end of the transfer conveyor has an underside detachably connectable to centering device 14 of a like freight car 1 following the freight car in the conveying direction.

Figure 3:
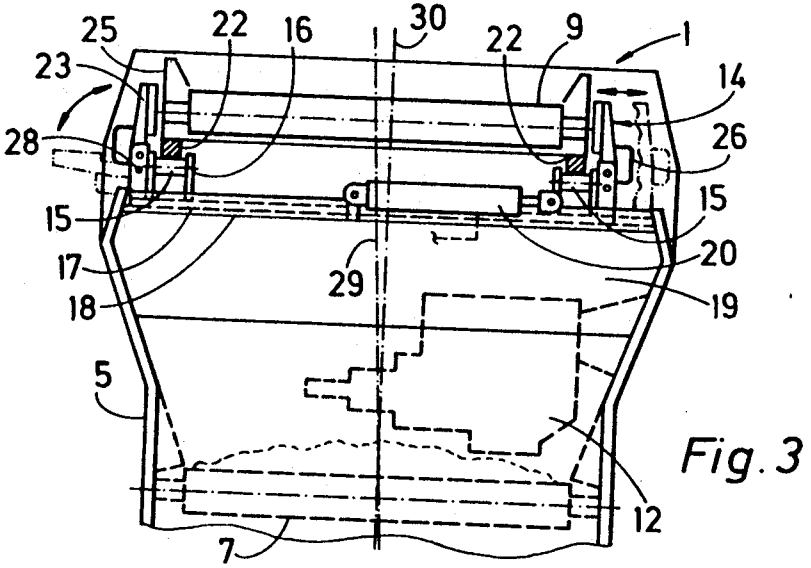
FIG. 3 is a transverse sectional view along lines III—III of FIG. 1, showing an end view of the freight car, the box being somewhat inclined with respect to a vertical center plane because of its position in a superelevated track section.
Figure 2:
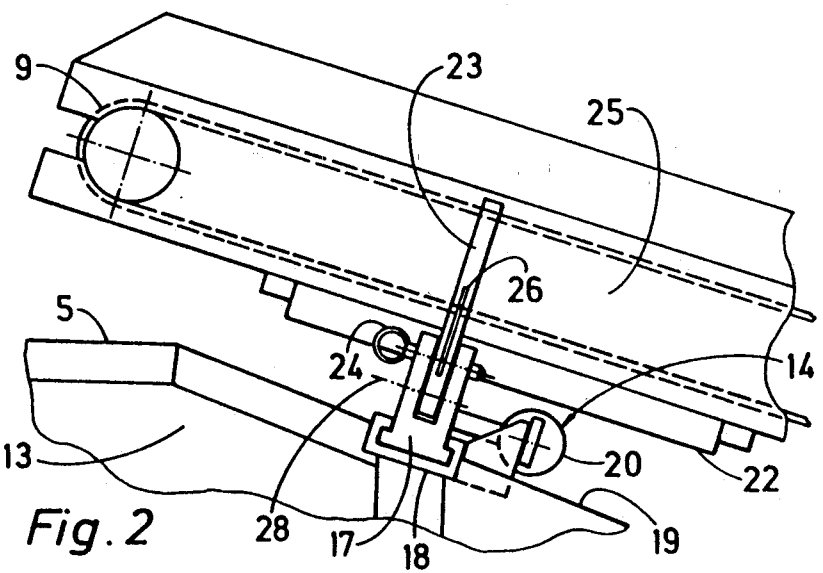
FIG. 2 is an enlarged fragmentary side elevation showing the centering device.

As shown in more detail in FIGS. 2 and 3, centering device 14 is affixed to box 5 at the one end thereof. As most specifically illustrated in FIG. 3, the centering device comprises two rollers 15 transversely spaced from each other by a distance approximating the width of transfer conveyor 9 and rotatable about a horizontal axis extending transversely with respect to the longitudinal direction of elongated car frame 2. The rollers support transfer conveyor 9 and are journaled on axle bearings 16 affixed to common sliding rail 17 which is glidably arranged in guide groove 18. The guide groove is provided in rear end wall 19 of box 5 and extends transversely with respect to the longitudinal direction of the car frame and horizontally over the entire width of the box. Cylinder-piston drive 20 for transversely displacing centering device 14 has its cylinder end affixed to rear end wall 19 while its piston end is connected to sliding rail 17, a transversely displaced position of the centering device being shown in phantom lines in FIG. 3. An operator at remote control 21 at the other end of the box may actuate drive 20 for effectuating the transverse displacement of centering device 14.

Two support ledges on an underside of transfer conveyor 9 at the free end thereof are spaced from each other transversely with respect to conveyor means 7 and extend in the longitudinal direction of transfer conveyor 9, and the support ledges are arranged to support the free transfer conveyor end on rollers 15 of centering device 14. The support ledges have a sufficient length to assure the secure support of transfer conveyor 9 on rollers 15 even at a maximal longitudinal displacement of support ledges 2 with respect to the rollers in track curves.

The illustrated centering device further comprises two flaps 23 spaced from each other transversely with respect to transfer conveyor 9 by a distance approximating the width thereof. The transfer conveyor has two side walls 25 adjacent flaps 23 and the flaps are pivotal about axis 28 extending in the longitudinal direction of frame 2 for selective engagement with transfer conveyor side walls 25. Means illustrated as abutment bolt 24 is provided for stopping pivotal flaps 23 in a vertical position for limiting the lateral pivoting of the free transfer conveyor end about pivot 10 and in a horizontal position for permitting the lateral pivoting. When the flaps are pivoted into their vertical position, their spacing slightly exceeds the width of transfer conveyor 9 so that they engage side walls 25 of the casing which holds the transfer conveyor and thus limit the lateral pivoting about pivot 10. As shown in phantom lines in FIG. 3, when flaps 23 are pivoted into their horizontal position, the transfer conveyor is free to pivot laterally so that it may be used, for example, to deposit bulk material on the side of track 4. To enable the flaps to be pivoted more readily, they are equipped with handles 26.

In operation, an operator at remote drive control 21 actuates drive 20 while observing conveyor means input 13 at the other end of box 5 when he sees the accumulation of the bulk material on conveyor means 13 to shift towards one side, i.e. towards the side of the lower rail in a superelevated track curve. In this way, centering device 14 and transfer conveyor 9 supported thereon is transversely displaced towards the opposite side, i.e. the higher rail, until the free transfer conveyor end is again centered with respect to bottom conveyor means 7.

If desired, this transverse displacement may be automatically controlled by cross level 27 mounted on freight car 1. This cross level measures the superelevation and generates control signals corresponding to the measured superelevation to actuate drive 20 in response thereto on the basis of predetermined parameters.

Reference numeral 29 indicates a vertical plane of symmetry of centering device 14 when the freight car operates on a horizontal track section while reference numeral 30 indicates an inclined plane of symmetry due to the superelevation of the track section.

The present invention is not limited to the specific embodiment illustrated herein. For example, the centering device for the transfer conveyor may be affixed to an underside of the free end of transfer conveyor 9 projecting beyond the coupling buffer attached to the end of the car frame.

What is claimed is:

1. A combination of two like, adjacently arranged freight cars for bulk material, each freight car comprising (a) an elongated frame supported on undercarriages and extending in a longitudinal direction, (b) an elongated box for holding the bulk material, the box being mounted on the frame and having a bottom and an open top, (c) an elongated conveyor means at the bottom of the box for transporting the bulk material in a conveying direction longitudinally extending along the box, the conveyor means having an input at one end of the box and an output at a box end opposite to the one end, (d) a transfer conveyor having a width and extending in the conveying direction, the transfer conveyor being arranged to receive the transported bulk material from the output of the conveyor means and having a free end projecting beyond the opposite box end to the one box end of the adjacently arranged freight car, (e) a centering device arranged at the one box end for transversely displacing the transfer conveyor of the adjacently arranged freight car, the centering device being transversely displaceably arranged with respect to the elongated frame and transfer conveyor, and the free end of the transfer conveyor of the adjacently arranged freight car, being detachably connectable to the centering device, and (f) a remote-controlled drive for transversely displacing the centering device.

2. The freight car of claim 1, further comprising a remote control for the drive at the opposite box end.

3. The freight car of claim 1, further comprising a cross level automatically controlling the transverse displacement drive of the centering device.

4. The freight car of claim 1, further comprising two support ledges on an underside of the transfer conveyor at the free end thereof, the support ledges being spaced from each other transversely with respect to the conveyor means and extending in the longitudinal direction of the transfer conveyor, and the support ledges being arranged to support the free transfer conveyor end on the centering device.

5. The freight car of claim 1, wherein the free end of the transfer conveyor projects beyond an end of the frame carrying a buffer for coupling the like freight car thereto, and the projecting free end of the transfer conveyor has an underside detachably connectable to the centering device of the like freight car following the freight car in the conveying direction.

6. The freight car of claim 1, wherein the centering device comprises two flaps spaced from each other transversely with respect to the transfer conveyor by a distance approximating the width thereof, the transfer conveyor having two side walls adjacent the flaps and the flaps being pivotal about an axis extending in the longitudinal direction of the frame for selective engagement with the transfer conveyor side walls.

7. The freight car of claim 6, wherein the centering device is arranged for laterally pivoting the free transfer conveyor end, further comprising means for stopping the pivotal flaps in a vertical position for limiting the lateral pivoting of the free transfer conveyor end and in a horizontal position for permitting the lateral pivoting.

* * * * *